148-111 AU 111 EX
11/18/86 OR 4,623,407

United States Patent [19]
Suga et al.

[11] Patent Number: 4,623,407
[45] Date of Patent: Nov. 18, 1986

[54] METHOD FOR PRODUCING A GRAIN-ORIENTED ELECTRICAL STEEL SHEET HAVING A HIGH MAGNETIC FLUX DENSITY

[75] Inventors: Yozo Suga; Toyohiko Konno; Tadashi Nakayama, all of Kitakyushu, Japan

[73] Assignee: Nippon Steel Corporation, Tokyo, Japan

[21] Appl. No.: 534,293

[22] Filed: Sep. 21, 1983

[30] Foreign Application Priority Data

Sep. 24, 1982 [JP] Japan ..... 57-165066

[51] Int. Cl.[4] ..... H01F 1/04
[52] U.S. Cl. ..... 148/111; 148/308; 420/117
[58] Field of Search ..... 148/110, 111, 112, 113, 148/31.55; 75/123 B, 123 D, 123 L

[56] References Cited

U.S. PATENT DOCUMENTS

| | | | |
|---|---|---|---|
| 1,773,157 | 8/1930 | Wooldridge | 75/123 L |
| 2,599,340 | 6/1952 | Littmann et al. | 148/12.5 |
| 2,867,557 | 1/1959 | Crede et al. | 148/111 |
| 3,278,346 | 10/1966 | Goss | 75/123 L |
| 3,287,183 | 11/1966 | Taguchi et al. | 148/111 |
| 3,671,337 | 6/1972 | Kumai et al. | 148/111 |
| 3,764,406 | 10/1973 | Littmann | 148/111 |
| 3,841,924 | 10/1974 | Sakakura et al. | 148/111 |
| 3,846,187 | 11/1974 | Sakakura et al. | 148/112 |
| 3,853,641 | 12/1974 | Sakakura et al. | 148/111 |
| 3,867,211 | 2/1975 | Easton | 148/31.55 |
| 3,932,234 | 1/1976 | Imanaka et al. | 148/112 |
| 3,933,537 | 1/1976 | Imanaka et al. | 148/111 |
| 3,940,299 | 2/1976 | Goto et al. | 148/31.55 |
| 4,023,990 | 5/1977 | Lex | 75/123 L |
| 4,108,694 | 8/1978 | Shiozaki et al. | 148/111 |
| 4,299,622 | 11/1981 | Kimira et al. | 75/123 D |
| 4,302,257 | 11/1981 | Matsumoto et al. | 148/111 |
| 4,319,936 | 3/1982 | Dahlstrom et al. | 148/111 |
| 4,439,251 | 3/1984 | Shimoyama et al. | 148/31.55 |
| 4,456,812 | 6/1984 | Neiheisel et al. | 148/111 |

FOREIGN PATENT DOCUMENTS

| | | | |
|---|---|---|---|
| 2060697 | 5/1981 | United Kingdom | 148/31.55 |

*Primary Examiner*—John P. Sheehan
*Attorney, Agent, or Firm*—Kenyon & Kenyon

[57] ABSTRACT

The present invention relates to a method for producing a grain-oriented electrical steel sheet.

A feature of the present invention is to set S≦0.007%, Mn=0.08~0.45%, P=0.015~0.45% in a slab. The present inventive idea does away with the conventional concept of using MnS as an inhibitor. The present invention present incomplete secondary recrystallization by the S content, which is decreased to a level as low as possible. In addition, a product having a high magnetic flux density can be successfully produced by adding appropriate amounts of Mn and P. Due to these advantages, a high Si content of a slab, which leads to a watt loss reduction, can also be employed in the present invention. In addition according to the present invention, the temperature of slab heating, which is carried out prior to hot rolling, can be drastically decreased as compared with the prior art. Thus, an outstanding cost reduction can be realized due to the decrease in heat energy and complete prevention of the slag formation.

4 Claims, 7 Drawing Figures

S: 0.004%

S: 0.007%

S: 0.015%

S: 0.025%

METHOD FOR PRODUCING A GRAIN-ORIENTED ELECTRICAL STEEL SHEET HAVING A HIGH MAGNETIC FLUX DENSITY

BACKGROUND OF THE INVENTION

1. Field of the Invention

The present invention relates to a method for producing a grain-oriented electrical steel sheet having a high magnetic flux density.

2. Description of the Prior Art

Grain-oriented electrical steel sheet is a soft magnetic material composed of crystal grains having a so called Gross texture, expressed by {110}<001> by the Miller index in which the crystal orientation of the sheet plane is the {110} plane and the crystal orientation of the rolling direction is parallel to the <001> axis. Grain-oriented electrical steel sheet is used for cores of transformers, generators, and other electrical machinery and devices.

Grain-oriented electrical steel sheet must have excellent magnetization and watt loss characteristics. The magnetization characteristic is defined by the magnitude of the magnetic flux density induced in the grain-oriented electrical steel sheet by a predetermined magnetic field. Here, $B_{10}$ is used. Soft magnetic material having a high magnetic flux density, i.e., a good magnetization characteristic, can advantageously reduce the size of the electrical machinery and devices.

Watt loss is defined as power lost due to consumption as thermal energy in a core when it is energized by an alternating magnetic field having a predetermined intensity. Here, $W_{17/50}$ is used. As is known, the watt loss characteristic is influenced by the magnetic flux density, sheet thickness, the impurities, resistivity, and grain size of the grain-oriented electrical steel sheet. Increased demand has arisen for grain-oriented electrical steel sheet having a low watt loss along with the trend toward energy conservation.

Grain-oriented electrical steel sheet is produced by hot-and-cold rolling a slab to the desired final sheet thickness and then finally annealing the resultant steel strip to realize selective growth of the {110}<001> oriented primary-recrystallized grains, i.e., to realize so-called secondary recrystallization. Controlling the secondary recrystallization, it is possible to increase the proportion of the accurately {110}<001° oriented grains in the crystal grains, thereby increasing the magnetic flux density of the grain-oriented electical steel sheet and, thus, reducing the watt loss. It is important to develop production techniques allowing control of the secondary recrystallization.

Japanese Examined Patent Publication (Kokoku) No. 40-15644 (Taguchi et al) and Japanese Examined Patent Publication (Kokoku) No. 51-13469 (Imanaka et al) disclose basic techniques for producing a grain-oriented electrical steel sheet having a high magnetic flux density and decreased watt loss.

The basic techniques disclosed in the above two Japanese examined patent publications however suffer from some fundamental problems. In the method dislcosed in Japanese Examined Patent Publication No. 40-15644, it is difficult to achieve overall optimum production conditions and to stably produce grain-oriented electrical steel sheets having a high magnetic flux density. As a result, the method is not appropriate for the stable production of products having the best magnetic properties.

The method disclosed in Japanese Examined Patent Publication No. 51-13469 involves double cold rolling and use of an expensive element, such as Sb or Se. This method therefore involves high production costs.

Also, both the prior art methods require high slab heating temperatures, disadvantageous from the viewpoint of the energy used for heating the slab, decreased yield due to slag generation and increased repair costs of slab-heating furnaces.

The need for high slab heating temperatures is related to the fact that to realize secondary recrystallization, fine precipitates, such as MnS and AlN, must be finely and uniformly dispersed in phases in the steel, while the steel is subjected to processes prior to the final high temperature annealing, so as to suppress growth of primary recrystallized grains having orientations other than the {110}<001> orientation during the final high temperature annealing (inhibitor effect).

In order to form such dispersion phases, when heating a slab to make it rollable, one must raise the slab heating temperature high enough to solid-dissolve MnS, and other inhibitor elements. These later precipitate as MnS, AlN, and the like, when the steel is hot-rolled or subjected to hot-strip annealing. The greater the degree orientation desired, the larger the amount of MnS, AlN, and other fine precipitates that must be present in the steel and, therefore, the higher the necessary slab heating temperature. Japanese Unexamined Patent Publication No. 48-51852 discloses an improvement of the method of Japanese Examined Patent Publication No. 40-15644. In this method, the Si content of the starting material is increased. A high silicon content however, narrowly restricts the conditions under which AlN can be ensured in the hot-rolled strip. Also, since the silicon content is high, the temperature range at which AlN precipitates during hot rolling in an appropriate manner for the secondary recrystallization shifts higher, requiring a higher slab heating temperature.

The adoption of continuous casting has created additional problems in the production of grain-oriented electrical steel sheet. In continuous casting linear, secondary-recrystallization-incomplete portions, referred to as streaks, are occasionally generated in the steel. This impairs the magnetic properties of the steel. The problem of streaks is greatly aggravated by a high Si content. Whe the Si content exceeds 3.0%, stable production of grain-oriented electrical steel sheet becomes extremely difficult. Japanese Unexamined Patent Publication No. 48-53919 (M. F. Littman) discloses to remove the problem of streaks by subjecting a continuously cast steel strand to double hot-rolling steps when producing a hot rolled strip. Japanese Unexamined Patent Publication No. 50-37009 (Akira Sakakura et al) discloses a method for producing grain-oriented electrical steel sheet wherein a hot-rolled steel strip is produced by double hot-rolling steps. These two prior art methods, however, do not fully utilize the advantages of continuous casting, i.e., omission of rough rolling. Two later publications, Japanese Unexamined Patent Publication No. 53-19913 (Morio Shiozaki et al) and Japanese Unexamined Patent Publication No. 54-120214 (Fumio Matsumoto et al), disclose how to employ single hot-rolling to produce grain-oriented electrical steel sheet using a continuously cast strand. These proposals, however, necessitate reconstruction of a casting or rolling installation and still do not completely solve the problem of streak generation.

SUMMARY OF THE INVENTION

It is an object of the present invention to provide a method for producing a grain-oriented electrical steel sheet having a magnetic flux density, $B_{10}$ of 1-89 Tesla or more using a single hot-rolling step.

It is another object of the present invention to provide a method for producing a grain-oriented electrical steel sheet in which stable secondary recrystallization can be obtained at a low slab heating temperature.

It is still another object of the present invention to provide a method for producing a grain-oriented electrical steel sheet in which excellent secondary recrystallization can be obtained at a higher Si content than in the prior art.

It is still another object of the present convention to provide a method for producing a grain-oriented electrical steel sheet using a continuously cast slab.

It is still another object of the present invention to provide a method for stably producing a grain-oriented electrical steel sheet under less strict production conditions than the prior arts.

The essence of the method according to the present invention resides in the steps of: heating, to a temperature not exceeding 1280° C., a slab which essentially consists of from 0.025% to 0.075% of C., from 3.0% to 4.5% of Si, from 0.010% to 0.060% of acid soluble aluminum, from 0.0030% to 0.0130% of N, not more than 0.007% of S, from 0.08% to 0.45% of Mn, and from 0.015% to 0.045% of P, the balance being Fe; hot rolling the slab to form a hot-rolled strip; annealing the hot-rolled strip at a temperature in the range of from 850° C. to 1200° C. for a short period of time; heavily cold-rolling the annealed strip at a reduction of not less than 80%, thereby obtaining the final sheet thickness; continuously decarburization-annealing the obtained cold-rolled strip in a wet hydrogen atmosphere and then applying an annealing separator on the strip; and, carrying out a final high temperature annealing.

One of the features according to the present invention is the sulfur content of 0.007% or less. In the prior art, as disclosed in Japanese Examined Patent Publication Nos. 30-3651, 40-15644, and 47-25250, sulfur is believed useful for producing grain-oriented electrical steel sheet since sulfur forms MnS, one of the indispensable precipitates for generating secondary recrystallization. According to these publications, the effect of sulfur is most prominent in a certain range of content is determined by the amount of solute MnS brought into solid solution during the slab-heating process. AlN also forms precipitates believed useful for producing a grain-oriented electrical steel sheet. Conventionally, both MnS and AlN precipitates were used as inhibitors.

The present inventors investigated in detail the precipitation behavior of MnS and AlN. They discovered that when a slab having the composition of an electrical steel sheet is heated and then hot-rolled and when a hot-rolled strip is annealed, MnS first precipitates at a high temperature and AlN then precipitates at a low temperature. Since MnS is already present in the steel when AlN precipitates, AlN tends to precipitate around the MnS, resulting in complex precipitation. Thus, the size and dispersion state of AlN are influenced by the precipitation states of MnS. That is, when the amount of MnS precipitated is great, the AlN is large sized and is dispersed non-uniformly.

As known from Japanese Unexamined Patent Publication No. 48-51852, a fundamental metallurgical concept for producing a grain-oriented electrical steel sheet having a high magnetic flux density with a single hot-rolling process is to create an appropriate dispersion state of AlN by utilizing the $\alpha \rightarrow \gamma$ transformation which occurs during hot-rolling or annealing. When the Si content is high, the $\alpha \rightarrow \gamma$ transformation is disadvantageously changed, so that dispersion of AlN is impaired. In the case of continuous casting, this is believed to result in generation of streaks.

Based on the above-described discoveries and consideration of the $\alpha \rightarrow \gamma$ transformation, the present inventors decreased the precipitation amount of MnS. They then discovered that, even with a high content of Si in the steel, the dispersion state of AlN can be kept uniform and the AlN precipitates be kept small in size.

One of the features according to the present invention therefore resides in the point that the sulfur content is lower than in the prior art. Even with this, the precipitation of AlN can be controlled appropriately and the generation of streaks in continuous casting which may occur when the Si content is high, can be prevented.

Since the sulfur content is low, the precipitation amount of MnS according to the present invention is less than in the prior art. The decrease in the precipitation amount of MnS means the total amount of the inhibitors is decreased, which tends to a decrease in the magnetic flux density. To compensate for the decrease in the magnetic flux density, Mn and P are added into steel in appropriate amounts.

Another feature according to the present invention resides in the fact that the Mn and P added to the steel do not change the inhibitors but render the primary recrystallization texture appropriate before the secondary recrystallization. That is, they compensate for the above-mentioned decrease in magnetic flux density is and even increase in the magnetic flux density by texture control. The crystal grains are refined and have a uniform size, with the result that the second recrystallization is stabilized.

Another feature according to the present invention is that Si content in the starting material is at least 30%, while stabilizing the secondary recrystallization and thus preventing the generation of streaks. This results in one of the lowest watt losses and highest magnetic flux density availabe in the high grade grain-oriented electrical steel sheet.

BRIEF DESCRIPTION OF THE DRAWINGS

The present invention will be described in further detail with reference to the drawings, wherein.

DESCRIPTION OF THE PREFERRED EMBODIMENTS

Figure 1A:
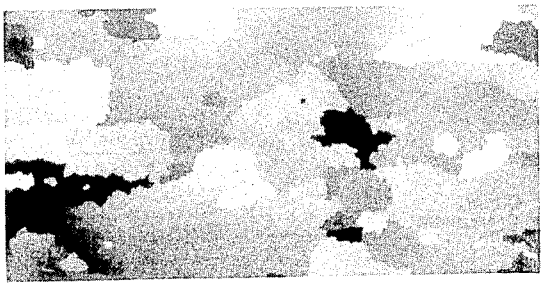
FIGS. 1A to 1D show photographs of the crystal grain-macrostructures of the products produced using steels containing 0.004%, 0.007%, 0.015%, and 0.025% of S.
Figure 1B:
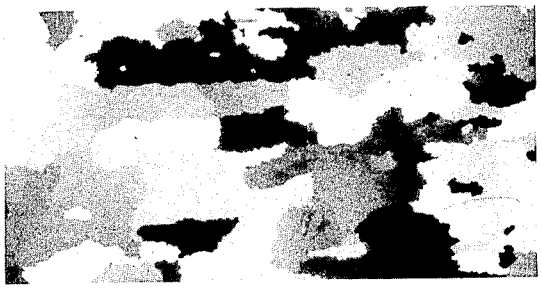
Figure 1C:
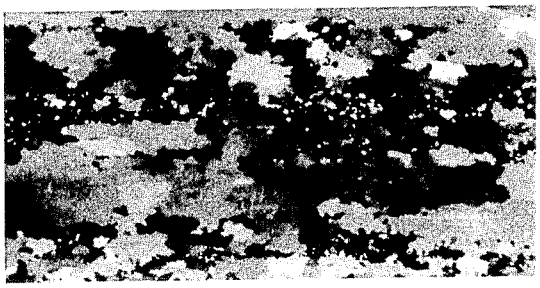
Figure 1D:
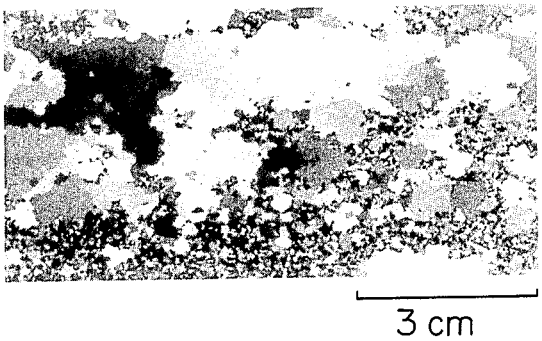

Four steels, in which the S contents were 0.004%, 0.007%, 0.015%, and 0.025%, respectively, and which contained 0.030% of C, 3.45% of Si, 0.030% of acid-soluble aluminum, and 0.0085% of nitrogen, were prepared in the form of 40 mm thick small samples. They were heated to 1200° C. in a furnace and then with drawn from the furnace, allowing them to cool in an ambient air down to the temperature of 1000° C. The four steels were then held in a furnace for 30 seconds at 1000° C. The four steels having the temperature of 1000° C. were hot-rolled by three passes to form 2.3 mm thick hot-rolled sheets. Then, the following processes were successively carried out: continuous annealing at 1100° C. for 2 minutes; cold-rolling to form a 0.30 mm cold-rolled sheet; decarburization-annealing in a wet hydrogen atmosphere; application of MgO; and final high temperature annealing at 1200° C. for 20 hours.

As is apparent from the crystal-grain macrostructures of the products shown in FIG. 1, no incomplete secondary recrystallization occurs when the S content is 0.007% or less. Also, according to experiments of the present inventors, no incomplete secondary recrystallization occurs when the Si content was 0.007% or less and when the S content was 0.007% or less. Accordingly, the S content is limited to 0.007% or less in the present invention. The S content is desirably decreased in the molten stage of melting steel because the desulfurization treatment during the final high temperature annealing can be facilitated. According to the present melting techniques for decreasing sulfur, the S content which can be easily attained without incurring cost increases is usually 0.001% or more.

Continuous casting slabs, in which the Mn and P contents were varied, and which contained 0.050% of C, 3.40% of Si, 0.002% of S, 0.030% of acid-soluble aluminum, and 0.0080% of nitrogen, were prepared in the form of 40 mm thick small samples. They were heated to 1150° C. in a furnace and were hot-rolled by three passes to form a 2.3 mm thick hot-rolled sheets. The finishing temperature of hot rollig was approximately 820° C.

Then, the following processes were successively carried out: continuous annealing at 1100° C. for 2 minutes; cold-rolling to form a 0.30 mm cold-rolled sheet; decarburization-annealing in a wet hydrogen atmosphere; application of MgO; and final high temperature annealing at 1200° C. for 20 hours.

Figure 2:
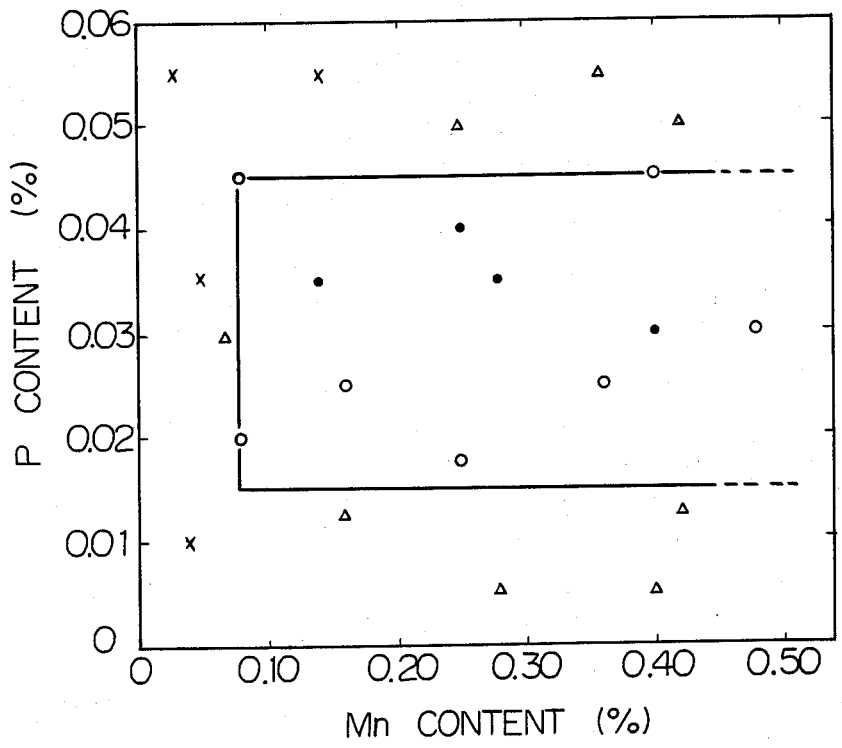
FIG. 2 is a graph of the influence of Mn and P upon magnetic flux densit $B_{10}$.

The magnetic flux density $B_{10}$ of the products is shown in FIG. 2. In FIG. 2 x corresponds to $B_{10}<1.80$ Tesla, Δ corresponds to $1.80 \leqq B_{10} < 1.89$ Tesla, o corresponds to $1.89 \leqq B_{10} \leqq 1.91$ Tesla, and . corresponds to 1.91 Tesla $<B_{10}$. As is apparent from FIG. 2, when the Mn content is low, the secondary recrystallization becomes unstable, and when the Mn content is high, the magnetic flux density $B_{10}$ is high. When Mn is added in more than a certain content, however it is ineffective for enhancing the magnetic flux density $B_{10}$ and is uneconomical since the amount of additive alloy becomes disadvantageously great.

When the P content is too low, the magnetic flux density $B_{10}$ is low and the generation of incomplete secondary recrystallization is increased. When the P content is too high, the frequency of cracking during cold rolling is increased.

Thus, the Mn content is limited to the range of from 0.08% to 0.45%, and the P content is limited to the range of from 0.015% to 0.045% according to the present invention. In these ranges the magnetic flux density $B_{10}$ is 1.89 Tesla or more, the secondary recrystallization is stable, and the problem of cracking is not significant.

Regarding the other components, steel which is subjected to the processes according to the present invention may be melted in a converter, electric furnace, or open-heath furnace, provided that the composition of steel falls within the ranges described hereinafter.

The C content is thus at least 0.025%. At a C content of less than 0.025%, secondary recrystallization is instable. Even if secondary recrystallization occurs, the magnetic flux density is low ($B_{10}$ is 1.80 Tesla at the highest). On the other hand, the C content is 0.075% at the highest, since the decarburization annealing time is long and thus uneconomical when the C content exceeds 0.075%.

The Si content is 4.5% at the highest. At an Si content exceeding 4.5%, numerous cracks occur during the cold-rolling. The Si content is at least 3.0%, preferably at least 3.2%. At an Si content less than 3.0%, the highest grade watt loss, i.e., $W_{17/50}$ of 1.05 w/kg at the sheet thickness of 0.30 mm, cannot be obtained.

Since in the present invention AlN is employed for the precipitates indispensable for the secondary recrystallization, the minimum amount of AlN must be ensured by providing an acid-soluble Al content and N content of at least 0.010% and 0.0030%, respectively. The acid-soluble Al content is 0.060% at the highest. At an acid-soluble Al content exceeding 0.060%, the AlN does not disperse uniformly in the hot-rolled strip, thereby resulting in poor secondary recrystallization. The N content is 0.0130% at the highest. At an N content exceeding 0.030%, the blisters form on the surface of the steel sheet.

When the steel has the composition as described above, a high slab heating temperature exceeding 1300° C., accepted as conventional practice, is not necessary. More surprisingly, when the present inventors heated two slabs to a high temperature and a low temperature, respectively, and then subjected them to the processes for producing grain-oriented electrical steel sheets, they found that two obtained products having an identical magnetic flux density will have a considerably lower watt loss when obtained by low-temperature slab heating than that when obtained by high-temperature slab heating. Thus, low-temperature slab heating not only enables production-cost reductions and easy use of a continuously cast strand as the starting material, but also a watt loss reduction.

Figure 3:
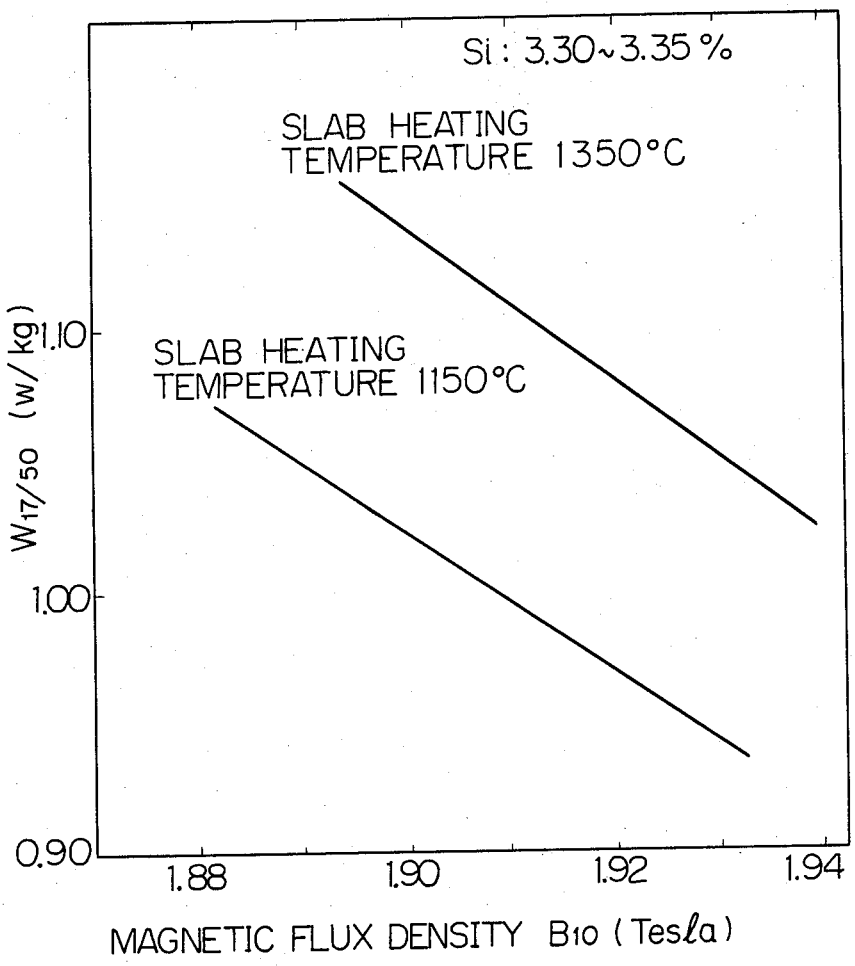
FIG. 3 is a graph of the magnetic properties of the products produced under the same conditions as in FIG. 2 but at slab heating temperatures of both 1150° C. and 1350° C.

FIG. 3 illustrates the magnetic properties of products produced under the same conditions as those of FIG. 3 but at slab heating temperatures of both 1150° C. and 1350° C. From the comparison of the two products (1150° C. and 1350° C.), it is apparent that a lower slab-heating temperature can drastically decrease the watt loss for the same magnetic flux density.

When the slab-heating temperature is 1280° C. or less, slag does not form at all during the slab heating. In addition, when the slab-heating temperature is 1280° C. or less and when the Si content is 3.0% or less, the highest grade product, i.e., a product which exhibits a watt loss $W_{17/50}$ of 1.05 w/kg or less at a sheet thickness of 0.30 mm, can be obtained.

The lowest slab heating temperature is not specifically limited, but is desirably 1050° C., since at a temperature lower than 1050° C., a great driving force is required for hot-rolling and the shape quality of steel strip is impaired. The lowest slab temperature of 1050° C. is therefore preferred from the viewpoint of the industrial production of the steel.

The slab used may be any slab produced by rough rolling or continuous casting. A continuously cast slab is preferable due to the inherent labor saving and yield-enhancement features of continuous casting. Furthermore, continuous casting ensures a uniform chemical composition in a slab, resulting in uniform magnetic properties in the longitudinal direction of the product.

As is described in Japanese Unexamined Patent Publication No. 53-19913, if a continuously cast slab is heated to a high temperature, such as approximately 1320° C., streaks generate and thus stable production becomes impossible. However, since the slab-heating temperature is 1280° C. or less according to the present invention, no incomplete secondary recrystallization occurs at all. The present invention therefore makes it possible to provide the highest-grade watt loss while employing low-temperature slab heating comparable to that of carbon steels.

Recent advances in continuous casting techniques have raised the productivity of continuous casting machines to equal the capacity of continuous hot-rolling mills. Continuous casting machines can therfore now be directly combined with continuous hot-rolling mills. When steels are supplied from a continuous casting machine directly to a continuous hot-rolling mill, the continuous hot-rolling mill can carry out rolling without a waiting period. Therefore, according to one advantageous hot rolling method which can be used in the present invention, a slab is not cooled after continuous casting and is directly hot-rolled while utilizing the sensible heat of the slab. Alternatively, according another advantageous hot-rolling method, a slab is loaded in a recuperator furnace when the temperature of the slab, especially the surface temperature, declines slightly. The slab is subsequently heated in a very compact heating furnace for carbon steels for a short period of time and then hot-rolled.

These hot-rolling methods are in active use for producing carbon steels. By using these methods for producing grain-oriented electrical steel sheet, a high hot-rolling efficiency comparable to that of carbon steels can be obtained.

When a continuous casting machine is directly combined with a continuous hot rolling mill, formation of internal cracks can be advantageously prevented. A slab which contains a large amount of silicon has low heat conductivity and, therefore, a great temperature difference. Thus, thermal stress is created between the surface and inner portions of the slab. If it is cooled after continuous casting, internal cracks are formed in the slab and thus the yield is lowered. However, since a slab is not cooled according to the advantageous hot-rolling method, formation of internal cracks can be advantageously prevented, which is an advantage specifically realized for hot-rolling silicon steels.

According to a conventional high-temperature slab heating method, a slab usually has a thickness of from 150 mm to 300 mm and is hot-rolled by a rough-rolling mill to form a 30 to 70 mm thick intermediate product. The intermediate product is then hot-rolled by a plurality of continuous finishing mills, to form a hot rolled strip having a predetermined thickness.

According to such a conventional method, a slab having a small thickness cannot be used, because the slab in deformed in a slab-heating furnace due to high temperature, with the result that the slab cannot be withdrawn from the furnace, or because a slab-heating furnace must be extremely long.

According to the low-temperature slab heating method, a thin cast slab can be used, because a cast slab can be directly hot-rolled. In addition, a thin cast slab can be directly finishing rolled while omitting the rough hot-rolling, thereby carrying out the hot rolling very effectively. If a slab is too thin, however, the production efficiency is low in continuous casting. On the other hand, if a slab is too thick, the load applied to a finishing hot-rolling mill is extremely great. A slab thickness is thus preferably from 30 mm to 70 mm.

In the method according to the present invention, the hot-rolled strip is annealed at a temperature of from 850° C. to 1200° C. for a short period of time and then rapidly cooled to control the precipitation state of AlN. If the annealing temperature is lower than 850° C., a high magnetic flux density cannot be obtained. On the other hand, if the annealing temperature is higher than 1200° C., the secondary recrystallization becomes incomplete. An annealing time of 30 seconds or longer is sufficient for attaining the object of annealing, and an annealing time longer than 30 minutes is economically disadvantages. The annealing time is usually from 1 to 30 minutes.

The annealing hot-rolles strip, which may be referred to as a hot-coil, is then cold-rolled. Heavy cold-rolling with a reduction a degree or draft of at least 80% is necessary in the cold-rolling for producing a grain-oriented electrical steel sheet having a high magnetic flux density.

The cold-rolled strip in then dicarburization-annealed. THe aims of the decarburization annealing are to decarburize and primary-recrystallize a cold-rolled strip and simultaneously to form on it an oxide layer which is necessary as an insulating film.

An annealing separator, which is necessary for forming an insulating film on the product, is applied on the surface of decarburization-annealed cold-rolled strip. The annealing separator is mainly composed of MgO and may additionally comprise, if necessary, one or more of $TiO_2$, $Al_3O_3$, CaO, B-compound, S-compound, and N compound.

Subsequently, final high-temperature annealing is carried out. The aims of the final high-temperature annealing are to secondary-recrystallization and purify a decarburization-annealed strip and to form an insulating film mainly composed of for stellite. Final high-temperature annealing is usually carried out at a temperature of 1100° C. or more in a hydrogen atmosphere or a mixture atmosphere containing hydrogen.

Upon completion of the secondary recrystallization, the temperature is usually elevated to approximately 1200° C. and purification annealing is carried out so as to reduce N and S is steel to a level as small as possible.

After the final high temperature annealing, a coating liquid mainly composed of, for example, phosphoric acid, chromic acid anhydride, and aluminum phosphate is applied on the steel strip, and annealing for flattening is carried out. Due to the coating film, the insulating film in further strengthened and can generate a high tension. An insulating film which essentially consists of $MgO.SiO_2$ is finally formed.

Figure 4:
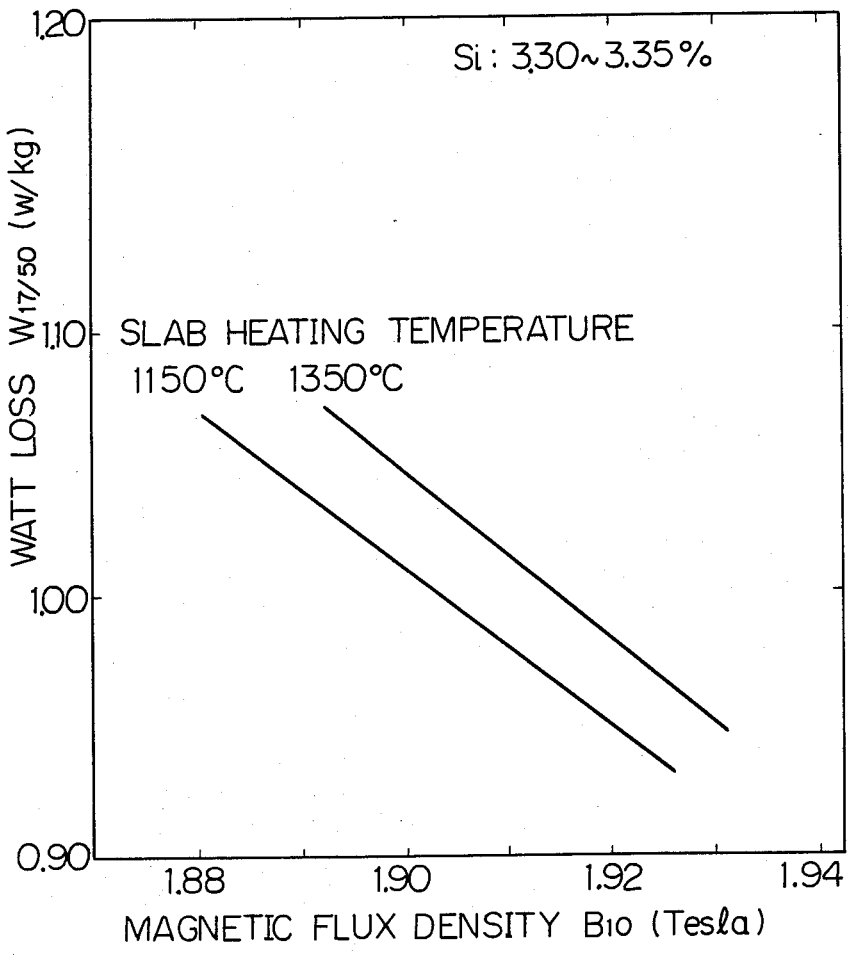
FIG. 4 is a graph similar to FIG. 3 regarding Cr-containing steels.

Continuous casting slabs which contained 0.060% of C, 3.33% of Si, 0.30% of Mn, 0.035% of P, 0.032% of acid-soluble Al, 0.0090% of N, 0.0090% S, and 0.15% of Cr were heated to 1150° C. and 1350° C. and then hot-rolled to form 2.3 mm thick hotrolled sheets. Then, the following processes were successively carried out: continuous annealing at 1150° C. for 2 minutes; cold-rolling to form 0.30 mm cold-rolled strips decarburization-annealing in a wet hydrogen atmosphere; application of MgO as annealing separator; final high temperature annealing at 1200° C. for 20 hours. FIG. 4 shows the relationship between magnetic flux density and watt loss. From FIG. 4, it will be understood that Cr can attain improved magnetic properties as steels without Cr (FIG. 3) does.

The present invention is now further described by way of examples.

EXAMPLE 1

Molten steel which contained 0.053% of C, 3.30% of Si, 0.25% of Mn, 0.030% of P, 0.006% of S, 0.027% of acid-soluble Al, and 0.0090% of N, was cast into an ingot. The ingot was rough hot-rolled to form a 250 mm thick slab. The slab was heated to 1150° C. and then hot rolled to form 2.3 mm thick hot-rolled sheets. Then, the following processes were successively carried out: continuous annealing at 1080° C. for 2 minutes; cold-rolling to form a 0.30 mm coldrolled sheet; decarburization-annealing at 850° C. in a wet hydrogen atmosphere; application of MgO; and final high temperature annealing at 1200° C. for 20 hours.

The magnetic properties of the product in the rolling direction were as follows:

$B_{10}=1.91$ Tesla $W_{17/50}=1.01$ w/kg.

No incomplete secondary recrystallization occurred.

EXAMPLE 2

Molten steel which contained 0.058% of C, 3.45% of Si, 0.20% of Mn, 0.035% of P, 0.005% of S, 0.026% of acid-soluble Al, and 0.0090% of N, was cast into a 250 mm thick strand by continuous casing followed by cooling down to 250° C. The cut slab was heated to 1200° C. and then hot rolled to form 2.3 mm thick hot-rolled sheets. Then, the following processes were successively carried out: annealing at 1080° C. for 2 minutes; cold-rolling to form a 0.30 mm coldrolled sheet; decarburization-annealing at 850° C. in a wet hydrogen atmosphere; application of MgO; and final high temperature annealing at 1200° C. for 20 hours.

The magnetic properties of the product in the rolling direction were as follows:

$B_{10}=1.91$ Tesla $W_{17/50}=0.97$ w/kg.

No incomplete secondary recrystallization occurred.

EXAMPLE 3

Molten steel which contained 0.055% of C, 3.35% of Si, 0.20% of Mn, 0.035% of P, 0.006% of S, 0.027% of acid-soluble Al, 0.009% of N, was cast by continuous casting using a mold having a 250 mm thick mold cavity. After solidification of molten steel, cut slabs were loaded quickly without cooling in a car bottom type heat-reserving furnace. When the temperature of the slab was homogenized so that the average temperature of the slab was approximately 1130° C., the hotrolling was carried out, to form 2.3 mm thick hot-rolled sheets. Then the following processes were successively carried out: annealing at 1080° C. for 2 minutes; cold-rolling to form a 0.30 mm cold-rolled sheet; decarburization-annealing at 850° C. in a wet hydrogen atmosphere; application of MgO; and final high temperature annealing at 1200° C. for 20 hours.

The magnetic properties of the product in the rolling direction were as follows:

$B_{10}=1.90$ Tesla $W_{17/50}=1.04$ w/kg.

No imcomplete secondary recrystallization occurred.

EXAMPLE 4

Molten steel which contained 0.060% of C, 3.45% of Si, 0.15% of Mn, 0.030% of P, 0.002% of S, 0.028% of acid-soluble Al, 0.0090% of N, was cast by continuous casting using a mold with a 250 mm thick mold cavity. During the continuous casting, heat-insulation was carried out in a continuous casting machine. And one end surface of the strand, which was liable to cool, was gas-heated for a short period of time, so as to decrease the cooling to a level as small as possible, such cooling occurring after solidification of the molten steel. The strands, i.e., slabs, were quickly transferred to the inlet side of a hot-rolling mill, and the hot-rolling was initiated when the cross sectional central part and surfacd part of slabs had a temperature of approximately 1200° C., and approximately 1050° C.

The slabs were hot-rolled to form a 2.3 mm thick hot-rolled sheets. Then, the following processes were successively carried out: annealing at 1080° C. for 2 minutes; cold-rolling to form a 0.30 mm cold-rolled sheet; decarburization-annealing at 850° C. in a wet hydrogen atmosphere; application of MgO; and final high temperature annealing at 1200° C. for 20 hours.

The magnetic properties of the product in the rolling direction were as follows:

$B_{10}=1.89$ Tesla $W_{17/50}=1.05$ w/kg.

We claim:

1. A method for producing a grain-oriented electrical steel sheet having high magnetic flux density in terms of B 10 of 1.89 Tesla or more, comprising the steps of:

heating to a temperature not exceeding 1280° C., a slab which essentially consists of from 0.025% to 0.075% of C, from 3.0% to 4.5% of Si, from 0.010% to 0.060% of acid soluble amuminum, from 0.0030% to 0.0130% of N, not more than 0.007% of S, from 0.08% to 0.45% of Mn, and from 0.015% to 0.045% of P, the balance being Fe;

subsequently hot rolling said slab to form a hot-rolled strip;

annealing said hot-rolled strip in a temperature in the range of from 850° C. to 1200° C. for a short period of time;

subsequently heavily cold-rolling the annealed strip at a reduction of not less than 80%, thereby obtaining the final sheet thickness;

continuously decarburization-annealing the obtained cold-rolled strip in a wet hydrogen atmosphere and then applying an annealing separator on the strip; and subsequently carrying out a final high temperature annealing.

2. A method according to claim 1, wherein said slab is a continuous casting slab.

3. A method for producing a grain-oriented electrical steel sheet having high magnetic flux density in terms of B 10 of 1.89 Tesla or more, comprising the steps of;

forming, by continuous casting, a slab which essentially consists of from 0.025% to 0.075% of C, from 3.0% to 4.5% of Si, from 0.010% to 0.060% of acid soluble aluminum, from 0.0030% to 0.0130% of N, not more than 0.007% of S, from 0.08% to 0.45% of Mn, and from 0.015% to 0.045% of P, the balance being Fe;

supplying said slab from a continuous casting machine to a hot rolling mill, while avoiding cooling down to room temperature, and starting hot-rolling at a temperature not exceeding 1280° C. and hot rolling said slab to form a hot-rolled strip;

annealing said hot-rolled strip in a temperature in the range of from 850° C. to 1200° C. for a short period of time;

subsequently heavily cold-rolling the annealed strip at a reduction of not less than 80%, thereby obtaining the final sheet thickness;

continuously decarburization-annealing the obtained cold-rolled strip in a wet hydrogen atmosphere and then applying an annealing separator on the strip; and subsequently carrying out a final high temperature annealing.

4. A grain-oriented electrical steel sheet having a high magnetic flux density in terms of B10 of 1.89 Telsa or more, formed from a slab essentially consisting of from 0.025% to 0.075% of C, from 3.0 to 4.5% of Si, from 0.010% to 0.060% of acid soluble aluminum, from 0.0030% to 0.0130% N, not more than 0.007% of S, from 0.08% to 0.45% of Mn, and from 0.015% to 0.045% of P, the balance being essentially Fe, wherein said sheet is produced by heating said slab to a temperature of from not exceeding 1280° C. and by suppressing, prior to a final high temperature annealing, a secondary recrystallization by means of an inhibitor determined by the composition of said slab.

* * * * *

UNITED STATES PATENT AND TRADEMARK OFFICE

CERTIFICATE OF CORRECTION

PATENT NO. : 4,623,407

DATED : November 18, 1986

INVENTOR(S) : Y. Suga et al.

It is certified that error appears in the above-identified patent and that said Letters Patent is hereby corrected as shown below:

ON TITLE PAGE: [75] Inventors: delete "Toyohiko Konno" and insert -- Fumio Matsumoto, Kawasaki --.

Signed and Sealed this

Eleventh Day of February, 1992

*Attest:*

HARRY F. MANBECK, JR.

*Attesting Officer*

*Commissioner of Patents and Trademarks*